US011241875B2

(12) United States Patent
Arnold et al.

(10) Patent No.: US 11,241,875 B2
(45) Date of Patent: Feb. 8, 2022

(54) VENTED RESERVOIRS WITH FLOATS FOR PRINT AGENTS

(71) Applicant: HEWLETT-PACKARD DEVELOPMENT COMPANY, L.P., Spring, TX (US)

(72) Inventors: Christopher John Arnold, Vancouver, WA (US); Melissa S. Gedraitis, Vancouver, WA (US); Russell S. Sauer, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/954,879

(22) PCT Filed: Jan. 10, 2018

(86) PCT No.: PCT/US2018/013080

§ 371 (c)(1),
(2) Date: Jun. 17, 2020

(87) PCT Pub. No.: WO2019/139568

PCT Pub. Date: Jul. 18, 2019

(65) Prior Publication Data

US 2020/0398553 A1 Dec. 24, 2020

(51) Int. Cl.
*B41J 2/175* (2006.01)
*B41F 31/02* (2006.01)

(52) U.S. Cl.
CPC ..... *B41F 31/02* (2013.01); *B41J 2/17566* (2013.01); *B41J 2002/17576* (2013.01)

(58) Field of Classification Search
CPC ..... B41F 31/02; B41J 2/17566; B41J 2002/17576
See application file for complete search history.

(56) References Cited

U.S. PATENT DOCUMENTS

| | | | | |
|---|---|---|---|---|
| 3,672,533 | A | 6/1972 | McKean | |
| 4,940,152 | A * | 7/1990 | Lin | A61J 9/00 215/11.1 |
| 5,653,943 | A | 8/1997 | Arnold | |
| 8,640,930 | B2 | 2/2014 | Nunez et al. | |
| 2004/0108340 | A1 * | 6/2004 | Witt | B67D 7/005 222/464.3 |
| 2014/0048547 | A1 | 2/2014 | Larrobis et al. | |

FOREIGN PATENT DOCUMENTS

| | | |
|---|---|---|
| CN | 103213400 | 7/2013 |
| EP | 1378485 A1 | 1/2004 |
| JP | S5382344 | 7/1978 |
| JP | 2016185644 | 10/2016 |

OTHER PUBLICATIONS

Water Tank Float Valve for Open Tanks, Jan. 24, 2010, printed on Oct. 23, 2017, http://www.freedrinkingwater.com/tank-float-valve.htm.

* cited by examiner

*Primary Examiner* — Sharon Polk

(74) *Attorney, Agent, or Firm* — Tong Rea Bentley & Kim LLC

(57) ABSTRACT

In example implementations, a storage apparatus is provided. The storage apparatus includes a sealed reservoir partially filled with a print agent. A float is partially submerged in the print agent. A weight is coupled to a submerged portion of the float. A vent is coupled to the float and an opening in the sealed reservoir. A valve is coupled to an unsubmerged portion of the float.

9 Claims, 5 Drawing Sheets

100

100

100

400

700

VENTED RESERVOIRS WITH FLOATS FOR PRINT AGENTS

BACKGROUND

Printing devices, multi-function devices, and the like can use ink to print images on a print medium, such as paper. Printing devices may include two-dimensional and three-dimensional printers. The ink or agent may be contained in a cartridge that is inserted into the printing devices. The ink may be dispensed from the cartridge onto a print medium in a controlled fashion to generate text or images on the print medium.

DETAILED DESCRIPTION

Examples described herein provide a vented reservoir for fluids, such as printing inks, print agents, and the like. The vented reservoir may be spill-proof. The ink or agents may be contained in a cartridge or reservoir during shipping or transport. However, as the ink is transported, the pressure inside of the reservoir may change. Thus, the reservoir may be vented.

However, as the reservoir is transported, the reservoir may be shaken, vibrated, flipped around, and the like. Thus, if the reservoir is vented, the printing ink and/or agents inside of the reservoir may leak out of the reservoir. Alternatively, contaminants and debris can enter the reservoir through the vents and contaminate the printing inks and/or agents inside of the reservoir.

Examples described herein provide a storage apparatus that includes a vented reservoir with a float (e.g., a floating vent) to store printing inks and/or agents. The float may be vented to allow the reservoir to control changes in pressure. In addition, the float is designed to prevent the ink or agents inside of the reservoir from leaking out of the reservoir and preventing any contaminants and debris from contaminating the ink or agents inside of the reservoir.

Figure 1:
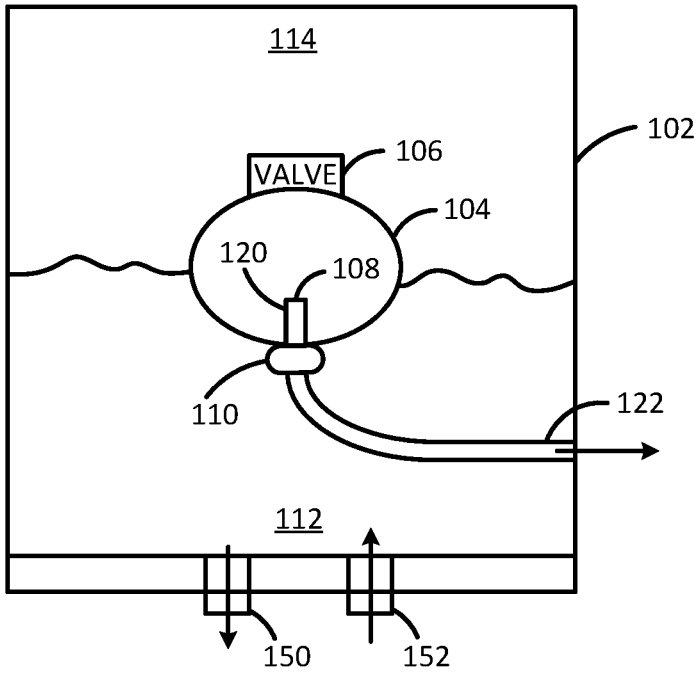
FIG. 1 is a block diagram of an example of a storage apparatus of the present disclosure.

FIG. 1 illustrates an example storage apparatus 100 of the present disclosure. The storage apparatus 100 may include a sealed reservoir 102 that includes a print agent 112 and air 114. In other words, the sealed reservoir 102 may be partially filled with the print agent 112. The print agent 112 may be a print ink, a print toner, a print liquid, or any other type of print agent. The sealed reservoir 102 may be fabricated from glass, a plastic, or any other type of material. The sealed reservoir 102 may be rigid or flexible.

In one example, the sealed reservoir 102 may include an outlet 150 and an inlet 152. The print agent 112 may be delivered to a printing system via the outlet 150. Additional print agent 112 may be delivered inside of the sealed reservoir 102 via the inlet 152.

Although the sealed reservoir 102 is shown as being a square, it should be noted that the sealed reservoir 102 may be any three dimensional shape such as a cube, a cylinder, a rectangular polygon, and the like.

The sealed reservoir 102 may contain a float 104. The float 104 may be fabricated from a plastic, or any other type of material such that the float 104 may be buoyant in the print agent 112.

Although the float 104 is illustrated in FIG. 1 as being circular, it should be noted that the float 104 may be any three dimensional shape. For example, the float 104 may be spherical, cylindrical, a polygon, a cube, an irregular polygon, and the like.

The float 104 may include a vent 108, a valve 106 and a weight 110. The vent 108 may be a tube that is inserted into the float 104. A first end 120 of the vent 108 may be inserted into the float 104. A second end 122 of the vent 108 may be coupled to an opening in the sealed reservoir 102. The second end 122 may help to remove air inside of the float 104 to the atmosphere when regulating the pressure inside of the sealed reservoir 102, as discussed below.

Although FIG. 1 illustrates the vent 108 being located at a bottom of a submerged portion of the float 104, it should be noted that the vent 108 may be located anywhere, included unsubmerged portions, on the float 104. In one example, the vent 108 may be a rigid tube. For example, the tube may be "rigid" in that the tube can stand erect when inserted into the float 104.

Figure 8:
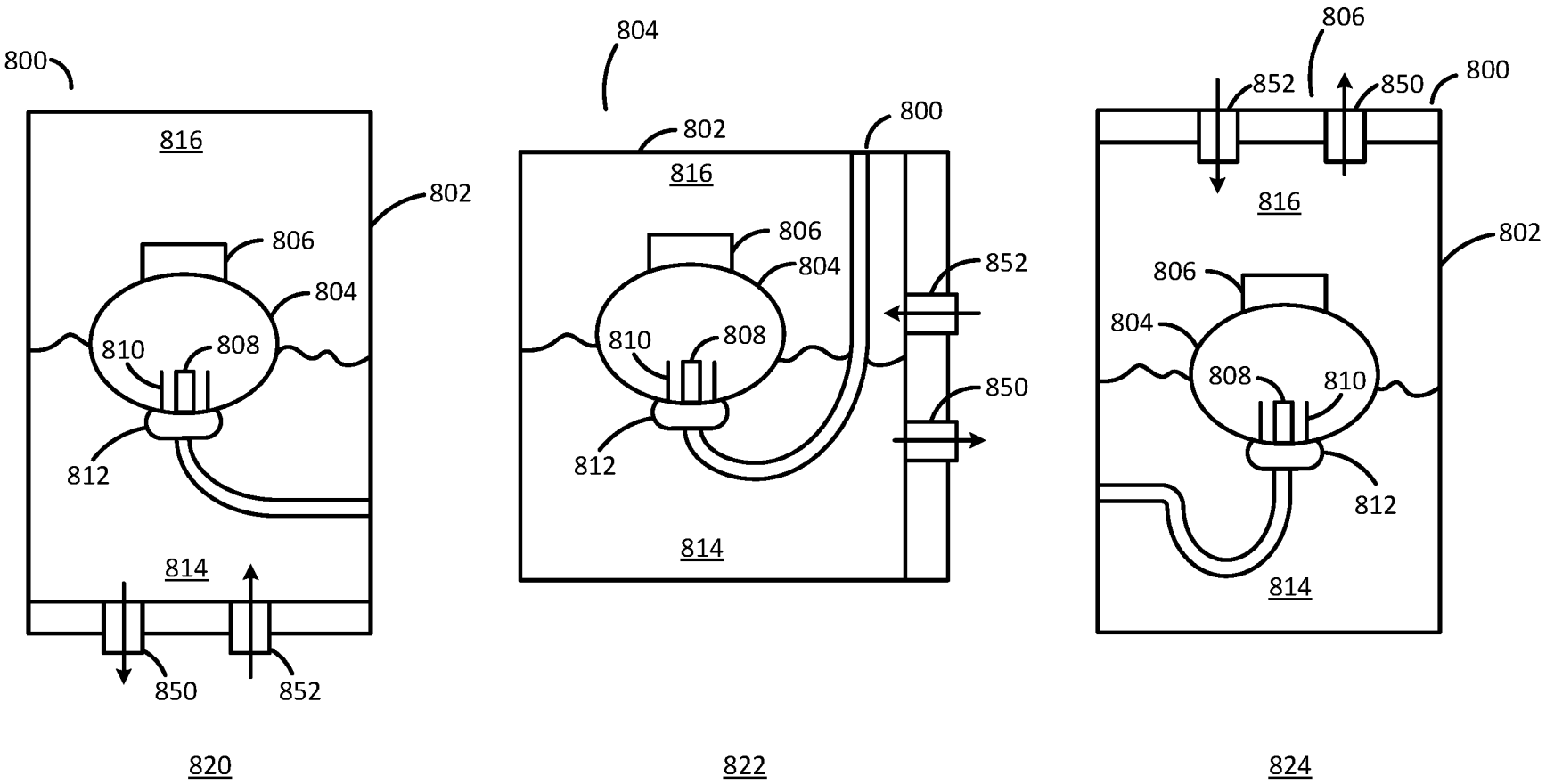
FIG. 8 illustrates example orientations of the storage apparatus of the present disclosure.

In one example, the float 104 may include a weight 110. The weight 110 may be coupled to a submerged portion of the float 104. In one example, the weight 110 may be coupled to a bottom most submerged portion of the float 104. In one example, the weight 110 may be coupled to a side that is opposite the valve 106. The weight 110 may weigh any amount that is sufficient to properly orientate the float 104 inside of the sealed reservoir 102. The weight 110 may ensure that the float 104 is correctly orientated regardless of the orientation of the sealed reservoir 102. Example orientations of a sealed reservoir and float are illustrated in FIG. 8 and discussed below.

In one example, the valve 106 may help to regulate the pressure inside of the sealed reservoir 102. For example, the storage apparatus 100 could be transported on an air plane that causes the air pressure to change. In another example, as the printing agent 112 is removed via the outlet 150, the pressure inside of the sealed reservoir 102 may change. The valve 106 may allow the pressure inside the sealed reservoir 102 to equalize to atmospheric pressure. The valve 106 may also allow air to be inserted back into the float 104 to help regulate the pressure inside of the sealed reservoir 102.

Figure 2:
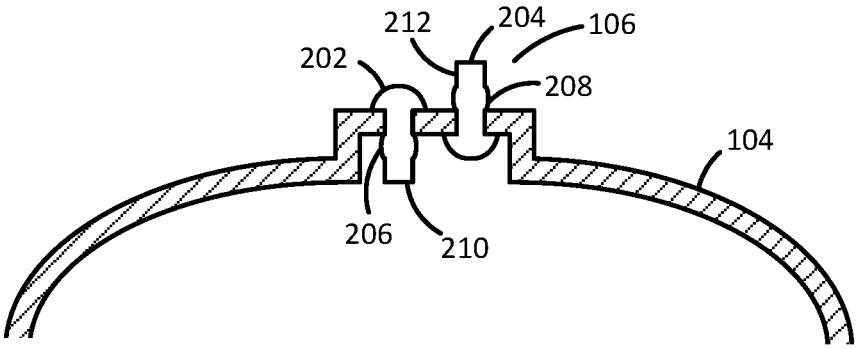
FIG. 2 illustrates an example of a valve of the storage apparatus.

FIG. 2 illustrates one example of the valve 106. The valve 106 may include an outlet valve 202 and an inlet valve 204. The outlet valve 202 and the inlet valve 204 may each be an umbrella valve. For example, the outlet valve 202 may include a stem 210. A ball 206 may be coupled to the stem 210. The ball 206 may be a rounded portion that is part of the stem 210.

The inlet valve 204 may include a stem 212. A ball 208 may be coupled to the stem 212. The ball 208 may be a rounded portion that is part of the stem 212.

In one example, the size of the ball 206, the ball 208, and the respective openings in the float 104 may be a function of a desired cracking pressure to control a pressure inside of the float 104. For example, the higher the desired cracking pressure, the tighter the fit may be between the ball 206, the ball 208, and the respective openings in the float 104. As the desired cracking pressure is decreased, the fit between the ball 206, the ball 208, and the respective openings in the float 104 may be less tight or looser.

In one example, as the pressure inside the sealed reservoir 102 decreases (e.g., due to changes caused by removal of the print agent 112 from the sealed reservoir 102 via the outlet 150) and exceeds the desired cracking pressure, the outlet valve 202 may be pushed out of the respective opening to allow air to enter from the float 104. As the pressure recedes back below the desired cracking pressure, the outlet valve 202 may fall back into the respective opening.

Similarly, in some cases the pressure around the float 104 may exceed a desired cracking pressure. As a result, the inlet valve 204 may be pushed out of the respective opening to allow air to enter the float 104.

Figure 3:
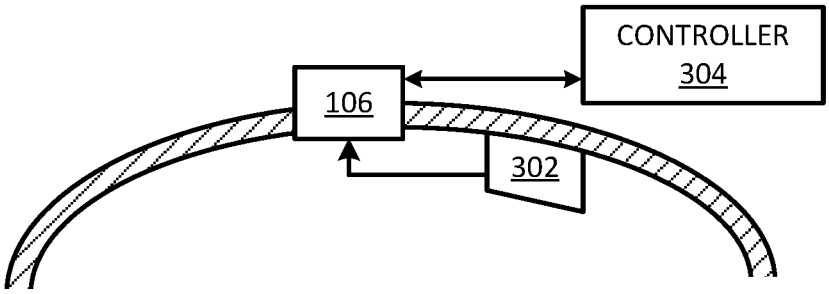
FIG. 3 illustrates another example of the valve of the storage apparatus.

FIG. 3 illustrates another example of the valve 106. In one example, the valve 106 may be a two-way valve (e.g., that allows flow into and out of the sealed reservoir 102) that is actuated and controlled by a controller 304. The controller 304 may be a processor or microcontroller. The controller 304 may be located inside of a housing of the valve 106 and powered by a battery. A pressure sensor 302 may be located inside of the float 104 to measure a pressure of the sealed reservoir 102. In another example, the pressure sensor 302 may be located outside of the float 104 and inside of the sealed reservoir 102. The pressure sensor 302 may be communicatively coupled to the controller 304.

In one example, the controller 304 may continuously monitor pressure measurements from the pressure sensor 302. When the pressure measurement exceeds a high threshold, the controller 304 may cause the valve 106 to open to let air out of the sealed reservoir 102. When the pressure measurement falls below a low threshold, the controller 304 may cause the valve 106 to open to let air into the sealed reservoir 102.

In some instances, the valve 106 may be opened simultaneously as the storage apparatus 100 is being rotated, turned, or vibrated during transportation. As a result, it is possible that the print agent 112 may splash into the float 104 as the valve 106 is opening to regulate a pressure inside of the float 104.

However, as noted above, the vent 108 may be a rigid tube. The first end 120 of the vent may be extended up (e.g., several millimeters or centimeters) into the float 104. As a result, any print agent 112 that enters the float 104 may fall harmlessly to a bottom of the submerged portion of the float 104. In addition, by having the rigid tube as the vent 108, the print agent 112 may be unlikely to enter the vent 108 and escape through the second end 122 of the vent 108.

Figure 4:
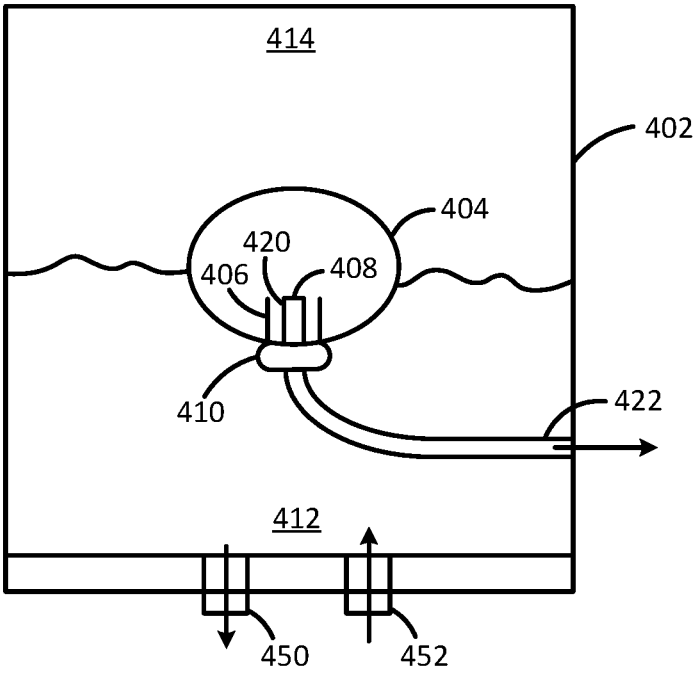
FIG. 4 is a block diagram of another example of a storage apparatus of the present disclosure.

FIG. 4 illustrates another example of a storage apparatus 400 of the present disclosure. The storage apparatus 400 may include a sealed reservoir 402 that includes a print agent 412 and air 414. In other words, the sealed reservoir 402 may be partially filled with the print agent 412. The print agent 412 may be a print ink, a print toner, a print liquid, or any other type of print agent. The sealed reservoir 402 may be fabricated from glass, a plastic or any other rigid polymer.

In one example, the sealed reservoir 402 may include an outlet 450 and an inlet 452. The print agent 412 may be delivered to a printing system via the outlet 450. Additional print agent 412 may be delivered inside of the sealed reservoir 402 via the inlet 452.

Although the sealed reservoir 402 is shown as being a square, it should be noted that the sealed reservoir 402 may be any three dimensional shape such as a cube, a cylinder, a rectangular polygon, and the like.

The sealed reservoir 402 may contain a float 404. The float 404 may be fabricated from a plastic, or any other type of material such that the float 404 is buoyant in the print agent 412.

Although the float 404 is illustrated in FIG. 1 as being circular, it should be noted that the float 404 may be any three dimensional shape. For example, the float 404 may be spherical, cylindrical, a polygon, a cube, an irregular polygon, and the like.

The float 404 may include a vent 408, a wall 406 and a weight 410. The vent 408 may be a tube that is inserted into the float 404. A first end 420 of the vent 408 may be inserted into the float 404. A second end 422 of the vent 408 may be coupled to an opening in the sealed reservoir 402. The second end 422 may help to remove air inside of the float 404 to the atmosphere when regulating the pressure inside of the sealed reservoir 402.

Although FIG. 4 illustrates the vent 408 being located at a bottom of a submerged portion of the float 404, it should be noted that the vent 408 may be located anywhere, included unsubmerged portions, on the float 404.

In one example, the float 404 may include the wall 406. The wall 406 may be positioned around the first end 420 of the vent 408 that extends into the float 404. The wall 406 and the vent 408 may be located in a submerged portion of the float 404. For example, the wall 406 and the vent 408 may be located on a bottom most part of the submerged portion of the float 404.

The wall 406 may be any shape. For example, the wall 406 may be a cylindrical shape, a cubic shape, a polygonal shape, or any other shape, around the vent 408.

In one example, a height of the wall 406 may be approximately equal to a length of the first end 420 of the vent 408 that is inserted into the float 404. In another example, the height of the wall 406 may be greater than the length of the first end 420 of the vent 408 that is inserted into the float 404.

As a result, any of the print agent 412 that may enter the float 404 may fall down along the inner walls of the float 404 towards the wall 406. The wall 406 may prevent the print agent 412 from entering up and into the vent 408 and out of the float 404 via the second end 422. For example, the float 404 may include an opening or valves (not shown), similar to the apparatus 100, that may allow the air 414 to enter and leave the float 404 and help to regulate the pressure inside of the sealed reservoir 402.

Figure 5:
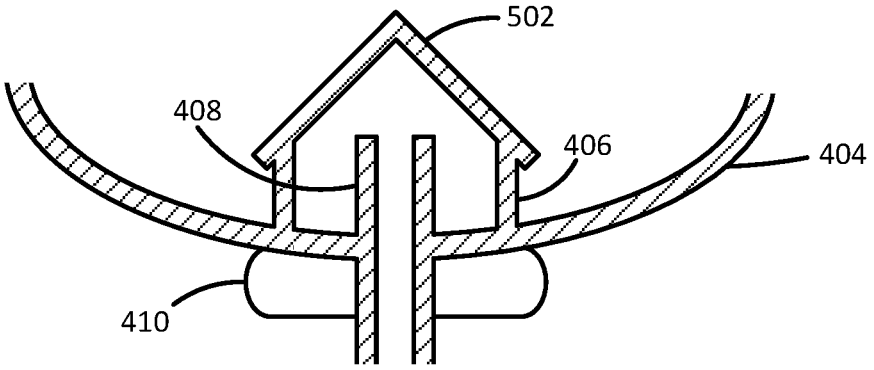
FIG. 5 illustrates an example of a wall of the storage apparatus with an umbrella.

FIG. 5 illustrates one example of the wall 406 with an umbrella 502. For example, the umbrella 502 may provide a "lid" on top of the wall 406 to further ensure that the print agent 412 does not enter the vent 408. The umbrella 502 may have a conic shape, a pyramidal shape, and the like, to allow any print agent 412 that falls into the float 404 to slide down and outside of the wall 408.

Referring back to FIG. 4, the float 404 may include a weight 410. The weight 410 may be coupled to a submerged portion of the float 404. In one example, the weight 410 may be coupled to a bottom most submerged portion of the float 404. In one example, the weight 410 may be coupled to a side that is opposite the valve 406. The weight 410 may weigh any amount that is sufficient to properly orientate the float 104 inside of the sealed reservoir 102. The weight 410 may ensure that the float 404 is correctly orientated regardless of the orientation of the sealed reservoir 402. Example orientations of a sealed reservoir and float are illustrated in FIG. 8 and discussed below.

Figure 6:
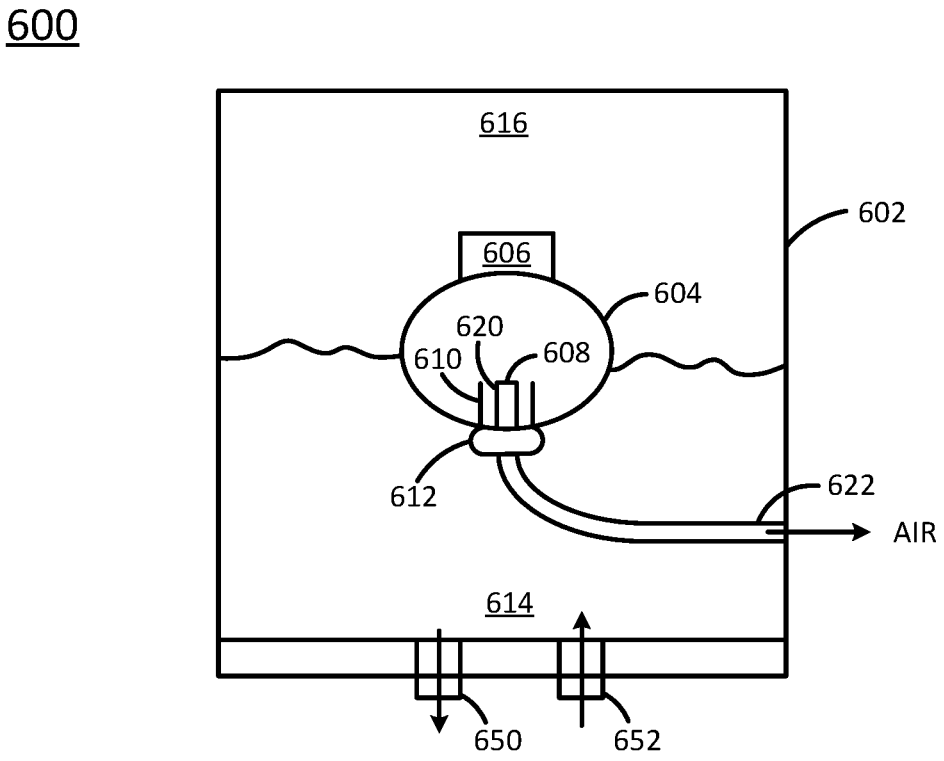
FIG. 6 is a block diagram of another example of a storage apparatus of the present disclosure.

FIG. 6 illustrates a block diagram of another example of a storage apparatus 600. In one example, the storage apparatus 600 may include a sealed reservoir 602 that includes a print agent 614 and air 616. In other words, the sealed reservoir 602 may be partially filled with the print agent 614. The print agent 614 may be a print ink, a print toner, a print liquid, or any other type of print agent. The sealed reservoir 602 may be fabricated from glass, a plastic, or any other material. The sealed reservoir 602 may be rigid or flexible.

In one example, the sealed reservoir 602 may include an outlet 650 and an inlet 652. The print agent 614 may be delivered to a printing system via the outlet 650. Additional print agent 614 may be delivered inside of the sealed reservoir 602 via the inlet 652.

Although the sealed reservoir 602 is shown as being a square, it should be noted that the sealed reservoir 602 may be any three dimensional shape such as a cube, a cylinder, a rectangular polygon, and the like.

In one example, a float 604 may be located inside of the sealed reservoir 602. The float 604 may be partially submerged in the print agent 614. The float 604 may be fabricated from a plastic, or any other type of material such that the float 604 is buoyant in the print agent 614.

Although the float 604 is illustrated in FIG. 6 as being circular, it should be noted that the float 604 may be any three dimensional shape. For example, the float 604 may be spherical, cylindrical, a polygon, a cube, an irregular polygon, and the like.

The float 604 may include both a valve 606 and a wall 610. In one example, the valve 606 may be coupled to an opposite side of the float 604 from a vent tube 608. For example, if the vent tube 608 is located on a bottom side of the float 604, the valve 606 may be located on a top side of the float 604.

In another example, the valve 606 may be coupled to an unsubmerged portion of the float 604. In other words, the valve 606 may be coupled to a portion of the float 604 that is not submerged in the print agent 614.

The valve 606 may include an inlet valve and an outlet valve, such as an umbrella valve, illustrated in FIG. 2 and described above. The valve 606 may also be a two-way valve that is operated by a controller and pressure sensor inside of the float 604 as illustrated in FIG. 3, and described above. The valve 606 may be used to regulate the pressure inside of the sealed reservoir 602 similar to the valve 106 illustrated in FIG. 1, and described above.

The wall 610 may be similar to the wall 406 illustrated in FIG. 4 and described above. The wall 610 may have shapes and be located similar to the wall 406. The wall 610 may also include an umbrella, or cover, similar to the umbrella 502 illustrated in FIG. 5, and described above.

As noted above, the float 604 may also include a vent tube 608 that is located on an opposite side of the float 604 from the valve 606. The float may include a weight 612. The vent tube 608 may have a first end 620 that is inserted into the float 604. The vent tube 608 may have a second end 622 that is coupled to an opening in the sealed reservoir 602. The second end 622 may help to remove air inside of the float 604 to the atmosphere when regulating the pressure inside of the sealed reservoir 602. The wall 610 may be located around the vent tube 608.

Figure 7:
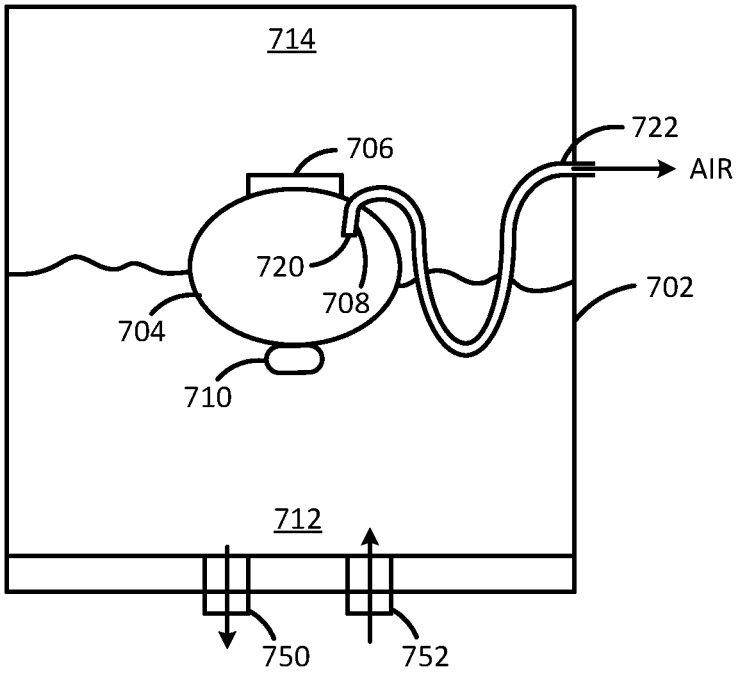
FIG. 7 illustrates an example of a vent tube inserted into an unsubmerged portion of a float.

Although FIG. 6 illustrates the vent tube 608 located in a submerged portion of the float 604, it should be noted that the vent tube 608 may be located anywhere in the float 604, included unsubmerged portions of the float 604. FIG. 7 illustrates an example, where a vent tube 720 is located on an unsubmerged portion of a float 704.

FIG. 7 illustrates a storage apparatus 700 that may be similar to the storage apparatuses 100, 400, and 600. The storage apparatus 700 has been simplified to illustrate the vent tube 720 being located on an unsubmerged portion of the float 704. For example, FIG. 7 illustrates a sealed reservoir 702 with a print agent 712 and air 714. The sealed reservoir 702 may additionally include an outlet 750 and an inlet 752. The float 704 may be partially submerged in the print agent 712. The float 704 may include a valve 706 and a weight 710.

The vent 708 may be located on an unsubmerged portion of the float 704, as noted above. The vent 708 may include a first end 720 inserted into the float 704 and a second end 722 coupled to an opening in the sealed reservoir 702. The vents 108, 408, and 608 may be similarly situated.

Referring back to FIG. 6, the weight 612 may be coupled to a submerged portion of the float 604. In one example, the weight 612 may be coupled to a bottom most submerged portion of the float 604. In one example, the weight 612 may be coupled to a side that is opposite the valve 606. The weight 612 may weigh any amount that is sufficient to properly orientate the float 104 inside of the sealed reservoir 102. The weight 612 may ensure that the float 604 is correctly orientated regardless of the orientation of the sealed reservoir 602.

FIG. 8 illustrates examples of a storage apparatus 800 and how a float 804 is properly oriented in a sealed reservoir 802 via a weight 812. The sealed reservoir 802 may be partially filled with a print agent 814 and air 816. The float 804 may be partially submerged in the print agent 814.

The float 804 may include a valve 806, a vent tube 808, a wall 810 that is located around the vent tube 808, and a weight 812. The weight 812 may be located on a submerged portion of the float 804. The weight 812 may be used to properly orientate the float 804 regardless of how the sealed reservoir 802 is oriented.

For example, in an initial upright orientation 820 (e.g., where the sealed reservoir 802 rests on a side including an outlet 850 and an inlet 852), the print agent 814 may be on a bottom half of the reservoir 802. The "upright" orientation of the float 804 may have the valve 806 located in the air 816 and the weight 812 located in the print agent 814.

The sealed reservoir 802 may be rotated onto a side orientation 822 (e.g., where the sealed reservoir 802 rests on a side adjacent to the side including an outlet 850 and an inlet 852). As a result, the print agent 814 may be located on a side of the sealed reservoir 802. However, the weight 812 may also rotate the float 804. For example, as the float 804 floats on the print agent 814 the weight 812 may sink towards the print agent 814 causing the float 804 to rotate into the correct "upright" orientation.

The sealed reservoir 802 may then be rotated into an upside down orientation 824 (e.g., where the sealed reservoir 802 rests on a side opposite the side including an outlet 850 and an inlet 852). As a result, the print agent 814 may be located on the top side of the sealed reservoir 802. However, the weight 812 may also rotate the float 804. For example, as the float 804 floats on the print agent 814 the weight 812 may sink towards the print agent 814 causing the float 804 to rotate into the correct "upright" orientation.

In addition, the weight 812 may keep the float 804 in the correct "upright" orientations in all orientations of the sealed reservoir 802 that may be in between the orientations 820, 822, and 824. For example, any angled orientation 360 degrees around. The weights 110, 410, and 612 may perform similarly to keep the floats 104, 404, and 604 in the correct orientation, as noted above.

Referring back to FIG. 6, the combination of all of the features illustrated in FIG. 6 may help to maintain a desired pressure inside of the sealed reservoir 602. In addition, the design of the float 604 may allow pressure to be controlled without allowing any of the print agent 614 to leak out during transportation.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A storage apparatus, comprising:

a sealed reservoir partially filled with a print agent;

a float partially submerged in the print agent;

a weight coupled to a submerged portion of the float;

a vent coupled to the float and an opening in the sealed reservoir; and a valve coupled to an unsubmerged portion of the float, wherein the valve comprises an outlet valve and an inlet valve.

2. The storage apparatus of claim 1, wherein the vent comprises a tube inserted into the float.

3. The storage apparatus of claim 2, wherein the tube comprises a rigid tube.

4. The storage apparatus of claim 1, wherein the outlet valve and the inlet valve each comprises an umbrella valve.

5. The storage apparatus of claim 1, wherein the dimensions of a respective ball coupled to a respective stem of the outlet valve and the inlet valve are sized in accordance with a desired cracking pressure to control a pressure inside of the sealed reservoir.

6. The storage apparatus of claim 1, comprising:

a pressure sensor to measure a pressure inside of the sealed reservoir;

a valve controller coupled to the valve; and a processor communicatively coupled to the pressure sensor and the valve controller to control operation of the valve in response to the pressure that is measured inside of the sealed reservoir.

7. A storage apparatus, comprising:

a sealed reservoir partially filled with a print agent;

a float partially submerged in the print agent;

a weight coupled to a submerged portion of the float;

a vent coupled to the float and an opening in the sealed reservoir, wherein the vent comprises a tube inserted into the float; and a wall around the vent coupled to the float, wherein a height of the wall is approximately equal to a length of the tube that is inserted into the float.

8. The storage apparatus of claim 7, wherein the wall and the vent are located in a submerged portion of the float.

9. A storage apparatus, comprising:

a sealed reservoir partially filled with a print agent;

a float partially submerged in the print agent;

a weight coupled to a submerged portion of the float;

a vent coupled to the float and to an opening in the sealed reservoir;

a wall around the vent and coupled to the float; and an umbrella coupled to the wall.

* * * * *